US005379625A

United States Patent [19]

Hale

[11] Patent Number: 5,379,625

[45] Date of Patent: Jan. 10, 1995

[54] METHOD AND APPARATUS FOR UPSETTING THE ENDS OF STEEL PIPE

[76] Inventor: John Hale, 2008 Highway 21 E., Bryan, Tex. 77803

[21] Appl. No.: 139,306

[22] Filed: Oct. 20, 1993

[51] Int. Cl.[6] ..... B21D 41/04

[52] U.S. Cl. ..... 72/318; 72/356; 72/370

[58] Field of Search ..... 72/318, 370, 306, 356, 72/357, 398, 401

[56] References Cited

U.S. PATENT DOCUMENTS 4,100,781 7/1978 Zawacki ..... 72/318
4,192,167 3/1980 Huebner ..... 72/370
4,845,972 7/1989 Takeuchi et al. ..... 72/370
5,184,495 2/1993 Chunn et al. ..... 72/318

FOREIGN PATENT DOCUMENTS 3216287 11/1983 Germany ..... 72/318

*Primary Examiner*—Daniel C. Crane
*Attorney, Agent, or Firm*—Gambrell, Wilson & Hamilton

[57] ABSTRACT

A method and apparatus for working one end of a steel pipe by externally upsetting the end in a first die set and sequentially shifting some of the upset internally by pressing in a second die with a reduced diameter mandrel to form a tapered internal shoulder in the pipe upset in only two passes.

3 Claims, 2 Drawing Sheets

METHOD AND APPARATUS FOR UPSETTING THE ENDS OF STEEL PIPE

BACKGROUND OF THE INVENTION

1. Field of the Invention

The present invention relates to a method and apparatus for upsetting end portions of pipe and particularly oilfield pipe to provide an increased wall thickness end portion for receiving tool joints or making threaded connectors on the pipe ends.

2. Description of the Prior Art

Oilfield tubulars which are typically connected together end to end by threaded couplings have, for many years, been provided with upset end portions at each end on which threads are cut or to which tool joints, i.e. the threaded coupling portions, are typically welded. Upsetting the tubular ends is usually done by forging in preparation for receiving the welded tool joint or threads and such upsetting operations have usually required a number of successive forging steps. For example, U.S. Pat. No. 4,845,972 and U.S. Pat. No. 5,184,495 each require a number of successive forging steps, and in some instances reheating the pipe end in order to work the end of the pipe to achieve the desired degree and shape of upset.

Since forging entails heating of the pipe end to facilitate working the metal and striking the end of the pipe a number of times in the forging die, it is advantageous to minimize the number of steps or passes in upsetting the pipe end, particularly if the entire operation can be achieved without the necessity of having to reheat the pipe at some stage during the process.

Each step in the upsetting operation requires working the pipe and reducing the number of working steps increases the overall efficiency of the upsetting operation so as to conserve both time and money. Since the pipe end must be red-hot during the upsetting operation, accomplishing the forging in as few a number of steps as possible is very advantageous.

It is an object of the present invention to provide a new and improved method and apparatus for upsetting pipe ends and particularly oilfield pipe for receiving welded on tool joints or threads for connecting joints of pipe end-to-end. The present invention employs only two forging steps by the die/mandrel combinations to form an upset end and also to provide a desired finish taper inside the pipe. This is accomplished with first and second dies and corresponding first and second mandrel combinations.

It is also an object of the present invention to combine pressing the forging during the second step to shift an externally displaced portion of the metal inwardly to also provide some internal upset in the pipe end.

IN THE DRAWINGS

FIG. 1 is a longitudinal section view showing end portions of a first die with a first mandrel positioned in the pipe end in the first step of the forging operation; and FIG. 2 is sectional view of the first mandrel/die combination taken along line 2—2 of FIG. 1 showing details of the die and mandrel combination at the first pass on the pipe end; and FIG. 3 is also a longitudinal section view showing a second die with a second cooperating mandrel in the pipe end after completing the second and final step of the forging operation for upsetting the pipe;

DETAILED DESCRIPTION OF THE INVENTION

Figure 1:
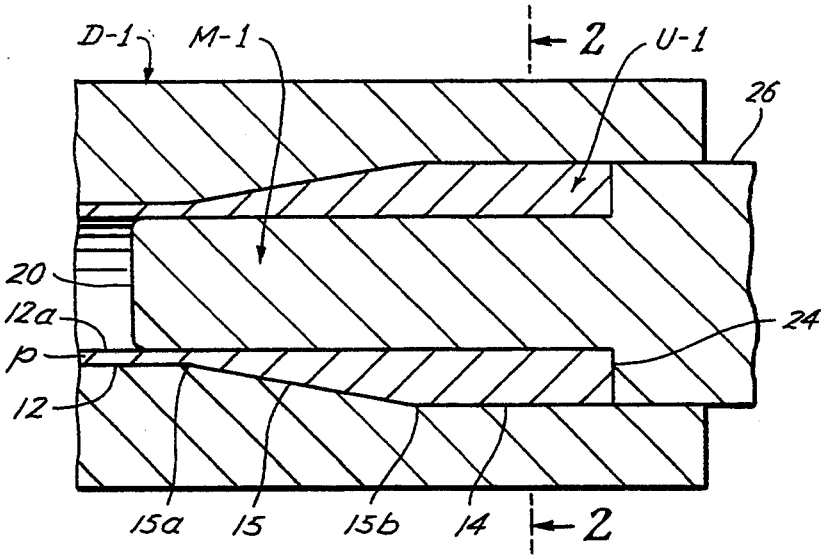
Figure 2:
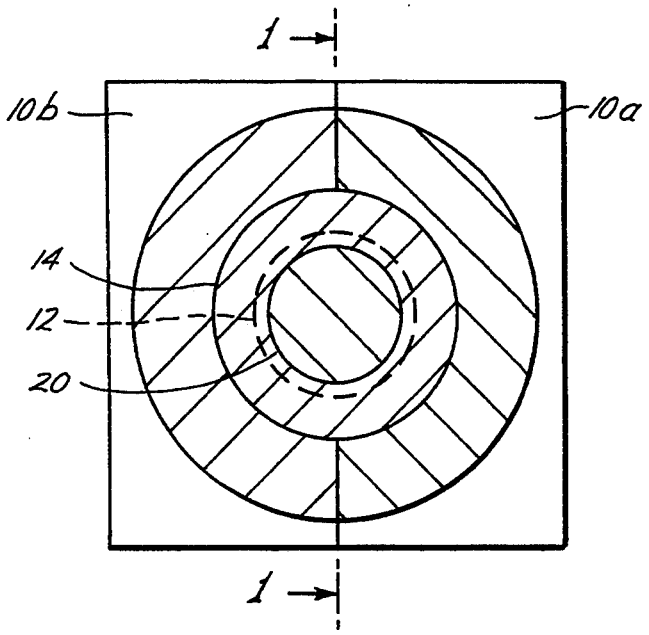

As shown in FIG. 1 of the drawings, there is a first die D-1 and a cooperating first mandrel M-1. As shown in FIG. 2, the die D-1 comprises a pair of mating die halves 10*a* and 10*b* which when laterally joined together form a primary bore 12 and a larger counterbore 14. The primary bore 12 is substantially the same diameter as the o.d. of the unworked pipe or tubular member P being worked in the forging operation.

Both the bore 12 and the counterbore 14 are substantially cylindrical and coaxial with the pipe P being worked.

In addition to the straight or cylindrical primary bore 12, the die D-1 has an intermediate tapered or flared portion 15, which is tapered radially outwardly to form a frusto-conical section that extends from its smaller end 15*a* to its larger end 15*b*, where it joins the counterbore 14.

It is understood that only the end portion of the pipe P being worked is heated in a furnace to a red-hot condition for forging in the die and mandrel combination and that the balance of the pipe P is not heated, but some portion of it is held firmly in a set of grips (not shown) while the hot end is being worked.

As shown in FIG. 1, the mandrel M-1 includes a cylindrical shaped probe 20 that has substantially the same cross-sectional size as the i.d. 12*a* of the unworked pipe P. The mandrel M-1 also has an annular shoulder 24 which extends radially outwardly from the probe 20 and which is of substantially the same o.d. as the i.d. of the counterbore 14 in the die D-1. The mandrel M-1 also includes an enlarged cylindrical body portion 26 extending laterally from the annular shoulder 24.

It will be appreciated that axial movement of the mandrel M-1 relative to the die D-1 against the hot end of the pipe P will force the hot metal in the end outwardly into the enlarged cavity portion of the die D-1 surrounding the end of the pipe P to form the first pass upset portion U-1 formed by expanding the hot metal outwardly into the enlarged cavity between the mandrel probe 20 and the surrounding die D-1.

Figure 4:
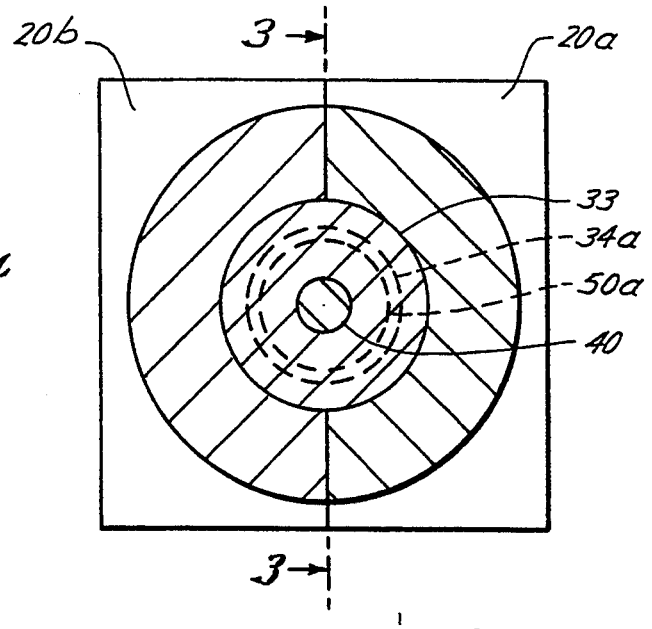
FIG. 4 is a section view of the second mandrel/die combination taken along line 4—4 of FIG. 3 of the drawing showing additional details of the second die and mandrel combination.

As soon as the required axial travel of the mandrel M-1 into the die D-I is completed, the mandrel is withdrawn from the hot tube or pipe and the pipe is moved immediately into position between a pair of mating die halves for the second forging step as illustrated in FIG. 4 of the drawings. As they are shown, a second stage die D-2 and a cooperating second stage mandrel M-2 are provided for completing the upset operation. The die D-2 comprises a pair of mating die halves 20*a* and 20*b* which, as shown in FIG. 4, when laterally joined together form a second stage primary bore 32 and a larger counterbore 33. The primary bore 32 is substantially the same diameter as the o.d. of the unworked pipe or tubular member P being worked in the forging operation.

The primary bore is also substantially cylindrical and coaxial with the pipe being worked. Additionally, there is an intermediate externally tapered or flared portion 34 which is tapered radially outwardly to form a frustoconical section that extends from its smaller end 34*a* adjacent the primary bore 32 to its larger end 34*b* adjacent to the larger counterbore 33. Again, with the hot tube positioned in the second die D-2 as shown, the second mandrel M-2 is moved axially into the open end of the tube with sufficient force to displace hot metal around the circumference of the open end and "upset" the tube, forming the resulting shape shown in FIG. 3 of the drawings.

Also, the mandrel M-2 is provided with a longitudinally extending probe portion 40 which projects beyond an annular shoulder 41 formed on the larger diameter body 44 of the mandrel M-2. The annular shoulder 41 extends outwardly to the outer perimeter of the body 44 which is of the same o.d. as the i.d. of the die chamber 33.

Figure 3:
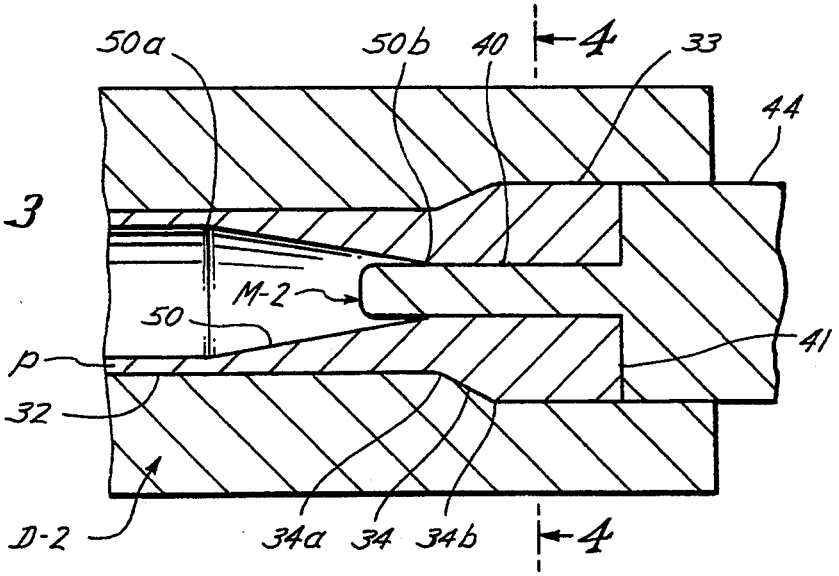

The die D-2 consists of mating halves 20*a* and 20*b* which are adapted to be moved laterally together to engage the enlarged upset portion formed by the first pass and to impose a radially inward force on the heated pipe end while the mandrel 40 is simultaneously moved axially into position so that its annular shoulder 41 engages the end of tubular member and together the die's halves 20*a* and 20*b* and the mandrel shoulder 42 perform a second pass upset to form the pipe end shown in cross-section in FIG. 3. This second upsetting action shifts a portion of the externally upset material from the first pass into an internally upset configuration due to the combination of forces from the mandrel M-2 and the surrounding die D-2, resulting in forming an internally tapered throat portion 50, which extends from the end 50*a* of the non-upset portion of the pipe P to the end 50*b*, which is of the same diameter as the mandrel probe 40.

The length of the internal taper 50 caused by the second upset step is substantially the same as the axial length of the external taper created by the first upset step. Thus, with the method and apparatus of the present invention an internally tapered upset end tubular member with sufficient wall thickness at the distal end for receiving a welded on tool joint may be created with only two upset steps and with current tubular forging equipment, these two steps can be accomplished quickly enough to eliminate the need for a second heating between the first step and the second upset step with the resulting increase in efficiency.

Figure 5:
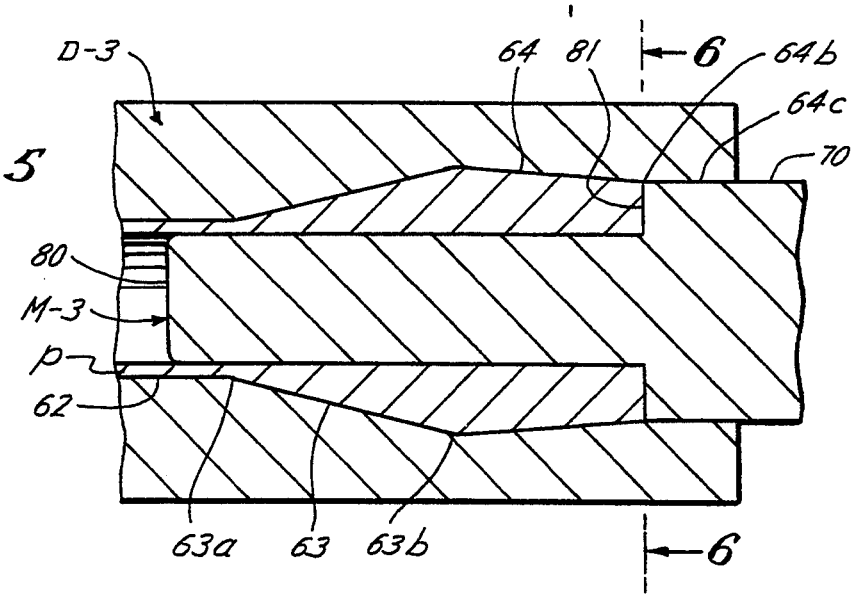
FIG. 5 is a longitudinal section showing a third die and mandrel combination on a pipe end for an alternative embodiment.
Figure 6:
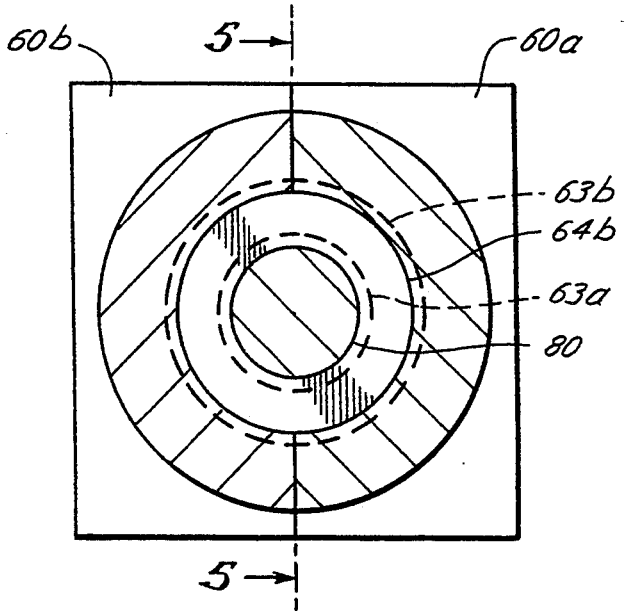
FIG. 6 is a sectional view taken on line 6—6 of FIG. 5.

FIGS. 5 and 6 show an alternative to the embodiment of the die and mandrel combination D-1/M-1. The alternative embodiment consists of a die D-3 and corresponding mandrel M-3.

The die D-3 consists of mating halves 60*a* and 60*b* as shown in FIG. 6 of the drawings which, when positioned laterally adjacent one another, form a primary bore 62 which is substantially the same diameter as the o.d. of the unworked pipe P. As shown in FIG. 5, the primary bore 62 joins a counterbore formed of a first inclined or tapered section 63, which is flared outwardly and a second inclined portion 64, which is flared inwardly. As shown, the first tapered portion flares outwardly beginning at the shoulder 63*a* which terminates at 63*b* that marks the largest diameter portion of the counterbore. The inclined portion 64 is largest at its juncture with the inclined portion terminating at 63*b* and tapers inwardly to 64*b* which is substantially the same diameter as the body 70 of the mandrel M-3. As shown, there is a cylindrical portion of the die adjacent the taper 64*b*, such cylindrical portion also having substantially the same i.d. 64*c* as the o.d. of the mandrel body 70.

Also, the mandrel M-3 is provided with a longitudinally extending probe portion 80 which projects beyond an axial shoulder 81 formed on the larger diameter body 70 of the mandrel M-3. The annular shoulder 81 engages the end of the tubular member or pipe P as it moves axially therein to upset the end of the pipe to fill the annular space between the mandrel probe 80 and the enlarged counterbore and the die D-3.

With this alternative embodiment of the present invention, a second pass or step is preferably performed by the die and mandrel combination D-2 and M-2 as shown and described with respect to FIGS. 3 and 4. With this latter arrangement, the wall thickness of the upset portion will be greater than with that formed using the first pass die-mandrel combination D-1/M-1 because of the internal taper of the die D-3 which accommodates a larger amount of upset in the first pass which is thereafter partially transferred to an internally tapered upset forming a heavier wall thickness than in the first instance.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

What is claimed:

1. A method of working the end of a steel pipe by external and internal upset forging comprising:

upsetting the external end of a pipe for increasing the peripheral wall thickness adjacent such end by moving a first mandrel having an external diameter substantially the same as the unworked tubular member axially relative to said pipe end in a first die having an internal end diameter larger than the external diameter of said unworked tube;

positioning said externally upset tube end between a pair of laterally moveable second dies and simultaneously moving said second dies laterally together to press said externally upset end portion radially inwardly while also moving a second mandrel having a smaller external diameter than said first mandrel axially into the open end of the pipe end whereby a portion of said externally upset material is moved inwardly to form a tapered internal upset portion extending inwardly from said unworked tubular portion to said smaller diameter passage formed by said second mandrel.

2. Method for upsetting the heated end of a uniform diameter pipe to form an end with an enlarged external diameter larger than the diameter of the uniform pipe and with a wall thickness greater than the wall thickness of the uniform pipe and an internal bore in said enlarged diameter end portion which has a smaller diameter than the internal diameter of said uniform pipe, comprising the steps of:

heating an end of the uniform diameter pipe;

holding the uniform diameter portion of the pipe against axial movement with the heated end in a first die having an enlarged diameter section with a diameter larger than the outer diameter of said uniform pipe diameter while striking the heated end of the pipe with a first mandrel to expand the uniform pipe into the enlarged diameter section of said first die to form an expanded pipe end;

inserting the expanded end of the pipe into a second die having a pair of movable forming dies and simultaneously moving said pair of movable dies together while also striking the heated end of said pipe a second time with a second mandrel to modify said initial upset of said heated end to form an internal bore in said enlarged diameter end portion that is of a smaller diameter than the bore of said uniform diameter pipe and to simultaneously form an internal taper in said heated end between said small diameter bore and said bore of said uniform diameter pipe without heating said pipe end a second time.

3. An apparatus for upsetting oilfield tubular goods, comprising:

a two-piece die adapted to being mated together to form a longitudinally extending cavity having a primary bore substantially the same internal diameter as a tubular member to be forged therein and having a larger diameter cylindrical counterbore disposed axially with respect to said primary bore and a tapered frusto-conical section extending from adjacent the end of said primary bore to said larger diameter counterbore;

a first mandrel adapted to be inserted into the larger diameter counterbore of said first die and having a longitudinally extending probe adapted to be inserted into the open end of said tubular member and being substantially the same external diameter as the internal diameter of said tubular member in its unworked condition;

a second die comprising a mating pair of die sections together forming a first bore of substantially the same internal diameter as the external diameter of an unworked tubular member, an enlarged diameter counterbore disposed axially with respect to said first bore and a first outwardly flared or tapered passage intermediate, said first bore and said counterbore and substantially shorter than the frusto-conical passage in said first die;

a second tapered section in addition to said first tapered section in which said tapered section is flared radially inwardly relative to said first bore, such that the smallest diameter of said second tapered section is smaller than the largest diameter of said second tapered section and larger than the largest diameter of said bore; and a second mandrel adapted to be inserted into the open end of said tubular member and having a cylindrical mandrel body with an external diameter substantially the same as the internal diameter of the larger counterbore of said second die, and a probe extending axially from said mandrel body and adapted to be inserted into the open end of said tubular member with said probe being of a smaller diameter than the internal diameter of the unworked tubular member.

* * * * *